US008616683B2

(12) United States Patent
Hara

(10) Patent No.: US 8,616,683 B2
(45) Date of Patent: Dec. 31, 2013

(54) LIQUID EJECTION DEVICE

(71) Applicant: Koichiro Hara, Nagoya (JP)

(72) Inventor: Koichiro Hara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/755,380

(22) Filed: Jan. 31, 2013

(65) Prior Publication Data

US 2013/0241996 A1 Sep. 19, 2013

(30) Foreign Application Priority Data

Mar. 13, 2012 (JP) ..... 2012-056238

(51) Int. Cl.
*B41J 2/045* (2006.01)

(52) U.S. Cl.
USPC ..... 347/68

(58) Field of Classification Search
USPC ..... 347/67–72
See application file for complete search history.

(56) References Cited

U.S. PATENT DOCUMENTS

| | | | | |
|---|---|---|---|---|
| 7,980,680 | B2 * | 7/2011 | Sugahara | 347/70 |
| 8,186,812 | B2 * | 5/2012 | Kura | 347/72 |
| 8,371,681 | B2 * | 2/2013 | Miyazawa | 347/68 |

FOREIGN PATENT DOCUMENTS

JP 2010-155407 A 7/2010

* cited by examiner

*Primary Examiner* — Lamson Nguyen
(74) *Attorney, Agent, or Firm* — Scully, Scott, Murphy & Presser, PC

(57) ABSTRACT

Pressure applying sections applying a pressure to ink in pressure chambers are arranged in a staggered array in a sheet feed direction to form a row. Four of such rows of the pressure applying sections are aligned in the scanning direction. One part of inspecting sections among plural inspecting sections detecting resonance frequencies are arranged respectively at positions deviating from both end parts and an approximately center part, in the sheet feed direction, of each row of the pressure applying sections toward both sides in the scanning direction, and are aligned in the sheet feed direction. The other inspecting sections are arranged on both sides, in the sheet feed direction, of the rows of the pressure applying sections, and are aligned in the scanning direction. Further, plural dummy electrodes are aligned with the one part of inspecting sections, the inspection electrodes, and the pads in the sheet feed direction.

21 Claims, 10 Drawing Sheets

LIQUID EJECTION DEVICE

CROSS-REFERENCE TO RELATED APPLICATIONS

This non-provisional application claims priority under 35 U.S.C. §119(a) on Patent Application No. 2012-056238 filed in Japan on Mar. 13, 2012, the entire contents of which are hereby incorporated by reference.

TECHNICAL FIELD

The present invention relates to a liquid ejection device ejecting liquid through a nozzle.

BACKGROUND

Japanese Patent Application Laid-Open No. 2010-155407 discloses an ink jet head comprising: a cavity unit provided with ink passages including a nozzle row group composed of two nozzle rows and a nozzle row group composed of six nozzle rows; and a piezoelectric actuator provided with three piezoelectric layers arranged on the upper face of the cavity unit and with electrodes arranged on and under the uppermost piezoelectric layer. The above-mentioned two nozzle row groups are arranged with an interval in between. Further, in the piezoelectric actuator, an inspection electrode pattern is formed between the two nozzle row groups. The electrostatic capacitance of the piezoelectric layer is measured by using the inspection electrode pattern and then a driving potential to be applied to the electrode is determined in correspondence to the measured electrostatic capacitance.

SUMMARY

In the piezoelectric actuator disclosed in Japanese Patent Application Laid-Open No. 2010-155407, in some cases, thickness variation occurs in the three piezoelectric layers depending on locations. When such thickness variation is present in the piezoelectric actuator depending on locations, variation in the ink ejection characteristics is caused among the nozzles in a case that an identical driving potential is applied to all electrodes so that the piezoelectric actuator is driven.

In Japanese Patent Application Laid-Open No. 2010-155407, as described above, a driving potential to be applied to the electrodes of the piezoelectric actuator is determined on the basis of the electrostatic capacitance measured by using the inspection electrode pattern or the like provided between the two nozzle row groups. Nevertheless, merely one configuration for detecting the electrostatic capacitance is provided between the two nozzle row groups. Thus, location-dependent variation in the electrostatic capacitance of the piezoelectric layers, that is, location-dependent variation in the thickness of the piezoelectric actuator, cannot be detected. Accordingly, although a plurality of piezoelectric actuators are allowed to be driven with mutually different driving potentials, within one piezoelectric actuator, an identical driving potential is applied to all electrodes unavoidably. Thus, variation in the ink ejection characteristics cannot be controlled among the nozzles.

Thus, in order to resolve such a problem, an object is to provide a liquid ejection device in which variation in the liquid ejection characteristics can be controlled among the plurality of nozzles.

The liquid ejection device according to a first aspect is a liquid ejection device comprising: a passage unit in which a plurality of nozzles and a plurality of pressure chambers in communication with the plurality of nozzles are aligned in one direction respectively; and a piezoelectric actuator arranged on the passage unit and applying a pressure to liquid in the plurality of pressure chambers, wherein in the passage unit, a plurality of inspection spaces not in communication with the plurality of nozzles are provided away from the plurality of pressure chambers in a perpendicular direction which is perpendicular to the one direction, the piezoelectric actuator includes: a first layer covering the plurality of pressure chambers and the plurality of inspection spaces: a second layer including at least a piezoelectric layer and being provided on a side of the first layer opposite to a side covering the plurality of pressure chambers and the plurality of inspection spaces, in a manner of overlapping with the plurality of pressure chambers and the plurality of inspection spaces; a plurality of driving electrodes provided at parts overlapping with the plurality of pressure chambers in the second layer; a plurality of inspection electrodes provided at parts overlapping with the plurality of inspection spaces in the second layer; and a plurality of voltage applying pads connected respectively to the plurality of inspection electrodes, and the plurality of inspection electrodes are provided away from the plurality of driving electrodes in the perpendicular direction, and are aligned in the one direction.

The liquid ejection device according to a second aspect is a liquid ejection device comprising: a passage unit in which a plurality of nozzles and a plurality of pressure chambers in communication with the plurality of nozzles are aligned in one direction respectively; and a piezoelectric actuator arranged on the passage unit and applying a pressure to liquid in the plurality of pressure chambers, wherein the piezoelectric actuator includes: a first layer covering the plurality of pressure chambers; a second layer including at least a piezoelectric layer and being provided on a side of the first layer opposite to a side covering the plurality of pressure chambers, in a manner of overlapping with the plurality of pressure chambers; a plurality of driving electrodes provided at parts overlapping with the plurality of pressure chambers in the second layer; and a plurality of voltage applying pads connected respectively to at least two or more driving electrodes among the plurality of driving electrodes, the driving electrodes connected respectively to the pads are inspection electrodes, and the inspection electrodes are aligned in the one direction.

According to the first and the second aspects, driving potentials or the like to be applied to the driving electrodes are determined in correspondence to the resonance frequencies of the plurality of inspection electrodes aligned in one direction similarly to the pressure chambers, and thereby controlling variation in the liquid ejection characteristics among the plurality of nozzles.

Further, in the second aspect, a part of the driving electrodes among the plurality of driving electrodes serve also as inspection electrodes, and thereby permitting size reduction in the liquid ejection device in comparison with a case that dedicated inspection electrodes are provided separately.

According to the first and the second aspects, driving potentials or the like to be applied to the driving electrodes are determined in correspondence to the resonance frequencies of the plurality of inspection electrodes, and thereby controlling variation in the liquid ejection characteristics among the plurality of nozzles.

The above and further objects and features will more fully be apparent from the following detailed description with accompanying drawings.

DETAILED DESCRIPTION

[First Embodiment]

A preferable first embodiment is described below.

Figure 1:
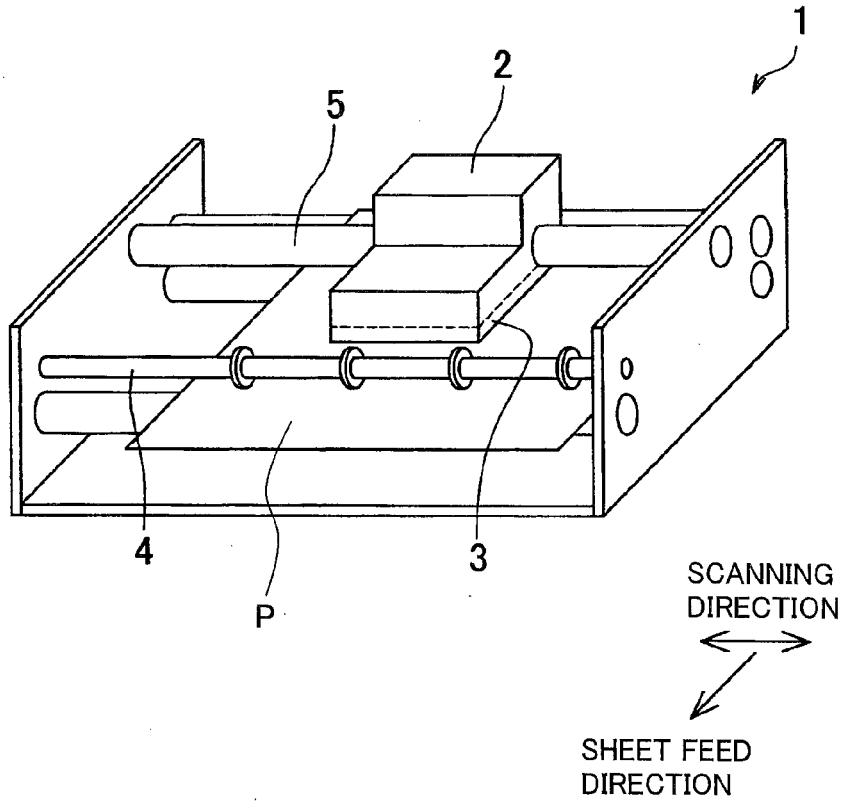
FIG. 1 is a schematic configuration diagram of a printer according to a first embodiment.

As illustrated in FIG. 1, a printer 1 according to the first embodiment comprises a carriage 2, an ink jet head 3, and a sheet conveying roller 4, and the like. The carriage 2 reciprocates along a guide bar 5 in the scanning direction. The ink jet head 3 is mounted on the carriage 2 and ejects ink through a plurality of nozzles 15 (see FIG. 3) formed in the lower surface of the ink jet head 3. The sheet conveying roller 4 conveys a recording sheet P in the sheet feed direction which is perpendicular to the scanning direction.

In the printer 1, ink is ejected from the ink jet head 3 reciprocating together with the carriage 2 in the scanning direction onto the recording sheet P conveyed by the sheet conveying roller 4 in the sheet feed direction, so that printing is performed on the recording sheet P. Further, the recording sheet P on which printing has been completed is discharged by the sheet conveying roller 4.

Figure 2:
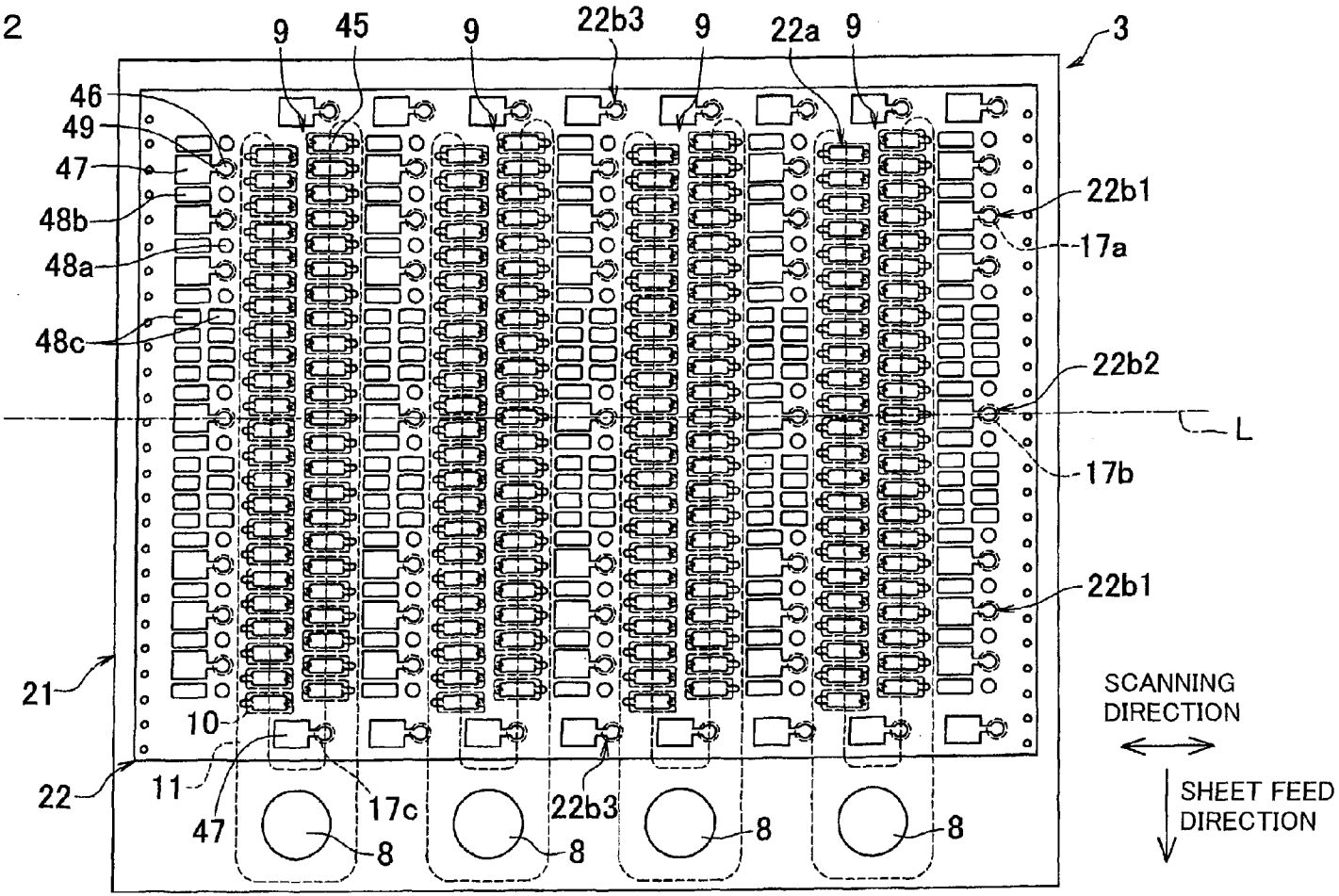
FIG. 2 is a plan view of an ink jet head illustrated in FIG. 1.
Figure 3:
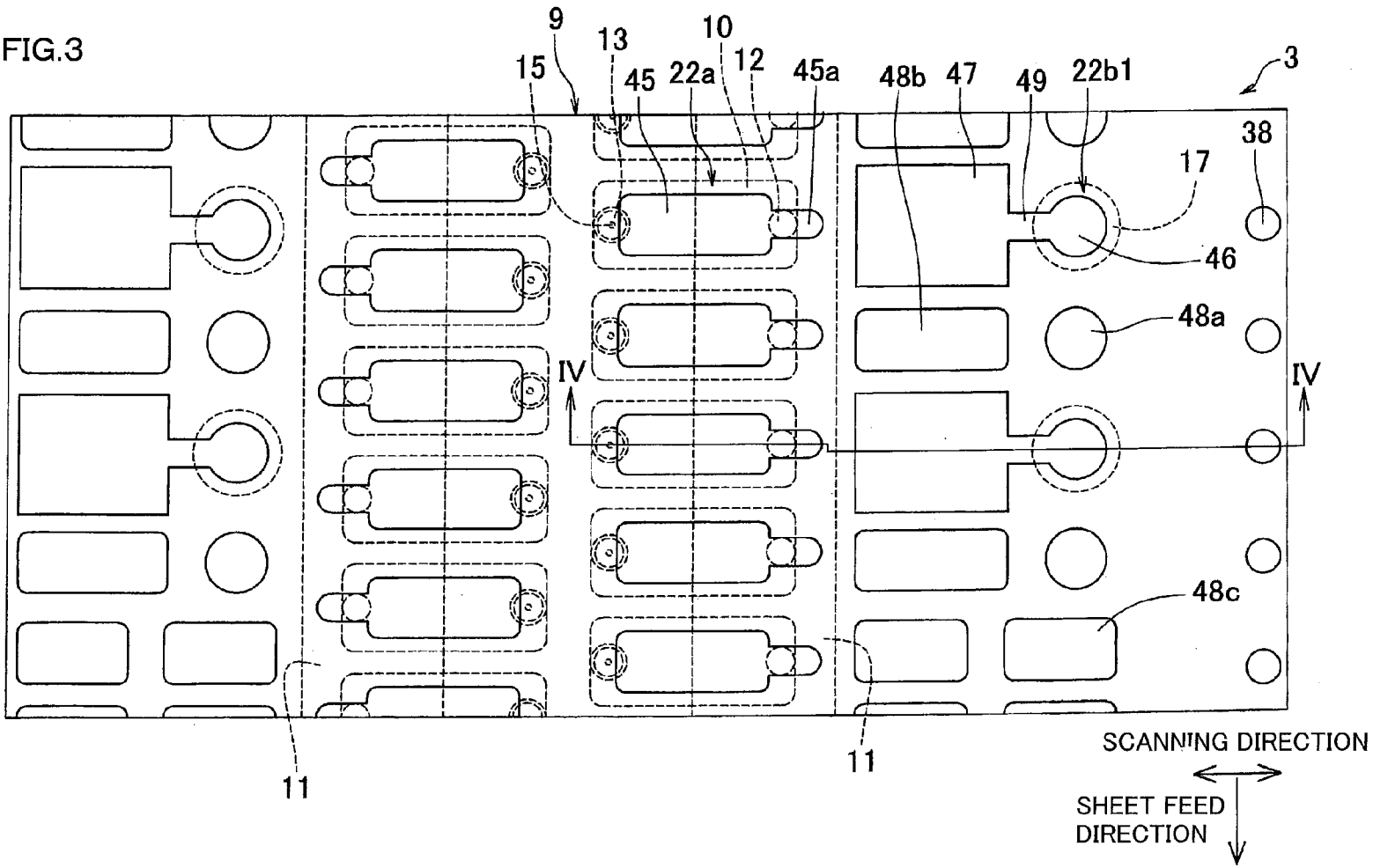
FIG. 3 is a partly enlarged view of FIG. 2.

Next, the ink jet head 3 is described below. As illustrated in FIGS. 2 and 3, the ink jet head 3 is provided with: a passage unit 21 in which ink passages like nozzles 15 and later-described pressure chambers 10 are formed; and a piezoelectric actuator 22 applying a pressure to the ink in the pressure chambers 10.

The passage unit 21 is formed such that four plates 31 to 34 are stacked successively in this order from the top and joined to each other with adhesive. Among the plates 31 to 34, the three plates 31 to 33 other than the lowest plate 34 are formed of metallic material such as stainless steel. Further, the plate 34 is formed of synthetic resin material. Alternatively, the plate 34 may also be formed of the same metallic material as the plates 31 to 33.

A plurality of pressure chambers 10 are formed in the plate 31. Each pressure chamber 10 has a plan-view shape of an approximate rectangle elongated in the scanning direction. Further, the plurality of pressure chambers 10 are arranged in a staggered array in the sheet feed direction so as to form a pressure chamber row 9. In the plate 31, four of such pressure chamber rows 9 are aligned in the scanning direction.

Further, in the plate 31, a plurality of inspection spaces 17*a* to 17*c* are formed, each of which has a plan-view shape of an approximate circle. Three such inspection spaces 17*a* are formed at each of positions deviating from both end parts, in the sheet feed direction, of each pressure chamber row 9 toward both sides in the scanning direction, and are aligned in the sheet feed direction. Such an inspection space 17*b* is formed at each of positions deviating from an approximate center part, in the sheet feed direction, of each pressure chamber row 9 toward both sides in the scanning direction, and are aligned with the inspection spaces 17*a* in the sheet feed direction. Eight such inspection spaces 17*c* are formed on each of both sides, in the sheet feed direction, of the four pressure chamber rows 9, and are aligned in the scanning direction.

In the plate 32, through holes 12 and 13*a* each having an approximate circle are formed respectively at parts overlapping with one end part and the other end part, in the longitudinal direction, of each pressure chamber 10. In the plate 33, manifold passages 11 are formed. In correspondence to the staggered array of the plurality of pressure chambers 10 in each pressure chamber row 9, two rows of such manifold passages 11 extend in the sheet feed direction with respect to each pressure chamber row 9 in a manner of respectively overlapping with an approximately half part on the through hole 12 side of the pressure chambers 10 arranged on one side, in the scanning direction, of each pressure chamber row 9 and with an approximately half part on the through hole 12 side of the pressure chambers 10 arranged on the other side. Further, ink is supplied to the manifold passages 11 through an ink feed opening 8 which is in communication with a base end part of the manifold passages 11. Further, in the plate 33, through holes 13*b* each having an approximately circular shape are formed at parts overlapping with the through holes 13*a*. In the plate 34, the nozzles 15 are formed at parts overlapping with the through holes 13*b*.

In the above-mentioned passage unit 21, each of the manifold passages 11 is in communication with the plurality of pressure chambers 10 through the through holes 12. Further, each pressure chamber 10 is in communication with the nozzle 15 through a descender passage 13 formed from the corresponding through holes 13*a* and 13*b*. As such, the passage unit 21 is provided with the manifold passages 11 and with a plurality of individual ink passages each extending from the exit of one of the manifold passages 11 through one of the pressure chambers 10 to one of the nozzles 15. Here, the inspection spaces 17*a* to 17*c* are independent spaces not in communication with the individual ink passages.

The piezoelectric actuator 22 includes an ink separation layer 41, a ceramics layer 42, a piezoelectric layer 43, a common electrode 44, a plurality of individual electrodes 45, a plurality of inspection electrodes 46, a plurality of voltage applying pads 47, and a plurality of dummy electrodes 48*a* to 48*c*, and the like.

The ink separation layer 41 is a plate-shaped member formed of metallic material such as stainless steel, and joined to the upper face of the plate 31 with adhesive such as to cover the pressure chambers 10 and the inspection spaces 17*a* to 17*c*. The ink separation layer 41 prevents the ink in the pressure chambers 10 from going into contact with the ceramics layer 42. The ceramics layer 42 is formed of piezoelectric material mainly composed of lead zirconate titanate which is mixed crystal of lead titanate and lead zirconate, and is joined to the upper face of the ink separation layer 41 with adhesive 26. The piezoelectric layer 43 is formed of piezoelectric material similar to that of the ceramics layer 42, and is arranged on the upper face of the ceramics layer 42. Further, the ceramics layer 42 and the piezoelectric layer 43 extend continuously such as to overlap with the plurality of pressure chambers 10 and the plurality of inspection spaces 17*a* to 17*c*.

Here, differently from the piezoelectric layer 43, the ceramics layer 42 may be formed of material other than piezoelectric material.

Figure 4:
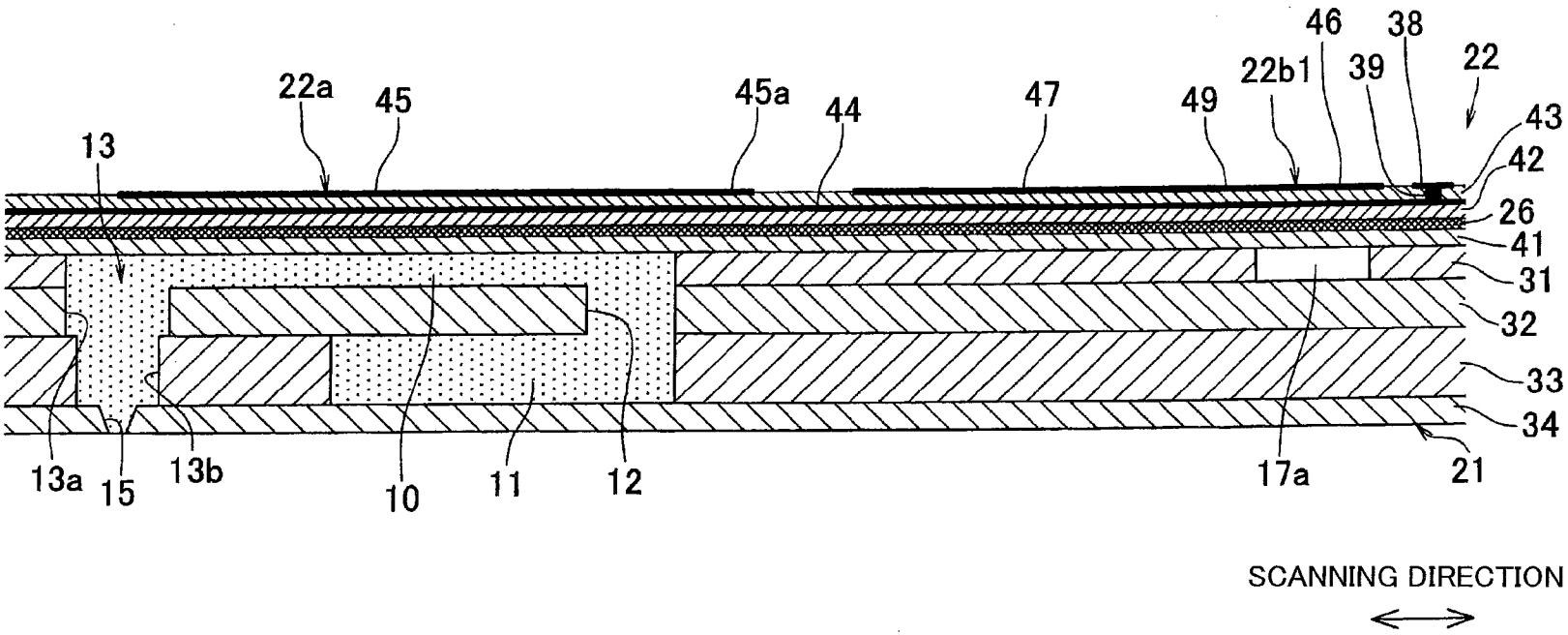
FIG. 4 is a sectional view of FIG. 3 taken along line IV-IV.

In the ink jet head 3, adhesive is present between the plates 31 to 34 and between the plate 31 and the ink separation layer 41. However, in FIG. 4, adhesive other than the above-mentioned adhesive 26 is not illustrated for simplicity of the drawing.

The common electrode 44 is arranged between the ceramics layer 42 and the piezoelectric layer 43, and extends approximately over the entire region thereof. The common electrode 44 is pulled out through a through hole 39 formed in the piezoelectric layer 43 to a surface electrode 38 formed on the upper face of the piezoelectric layer 43. The surface electrode 38 is connected through a wiring member (not illustrated) to a driver IC (not illustrated). The common electrode 44 is always held at the ground potential by the driver IC.

Each of the plurality of individual electrodes 45 has a plan-view shape of an approximate rectangle somewhat smaller than each pressure chamber 10, and is arranged at a part overlapping with an approximately center part of each of the plurality of pressure chambers 10 on the upper face of the piezoelectric layer 43. Further, each individual electrode 45 extends to a position not facing the pressure chamber 10 in a direction opposite to the nozzle 15 in the scanning direction, and the tip part of the individual electrode 45 forms a connection terminal 45*a*. The connection terminal 45*a* is connected through a wiring member (not illustrated) to the driver IC. Then, either the ground potential or a driving potential is selectively applied to the individual electrode 45 by the driver IC.

Each of the plurality of inspection electrodes 46 has a plan-view shape of an approximate circle somewhat smaller than those of the inspection spaces 17*a* to 17*c*, and is arranged at a part overlapping with an approximately center part of each of the inspection spaces 17*a* to 17*c* on the upper face of the piezoelectric layer 43.

The common electrode 44, the plurality of individual electrodes 45, and the plurality of inspection electrodes 46 are arranged in this manner. Thus, the piezoelectric layer 43 in the part located between each individual electrode 45 and the common electrode 44 and in the part located between each inspection electrode 46 and the common electrode 44 is polarized in the thickness direction of the piezoelectric layer 43.

Each of the plurality of pads 47 has a plan-view shape of an approximate rectangle whose length in the sheet feed direction is longer than that of the individual electrode 45, and has an area greater than that of the individual electrode 45. Each of the plurality of pads 47 is provided in correspondence to each of the plurality of inspection electrodes 46, and is arranged adjacent to the corresponding inspection electrode 46 in scanning direction. Each inspection electrode 46 and each pad 47 in mutual correspondence are connected to each other through a conduction section 49 formed on the upper face of the piezoelectric layer 43.

Each dummy electrode 48*a* has a plan-view shape of an approximate circle almost the same as that of the inspection electrode 46. The dummy electrodes 48*a* are arranged respectively on both sides, in the sheet feed direction, of the inspection electrodes 46 on the upper face of the piezoelectric layer 43. Each dummy electrode 48*b* has a plan-view shape of an approximate rectangle whose length in the sheet feed direction is shorter than that of the pad 47. The dummy electrodes 48*b* are arranged respectively on both sides, in the sheet feed direction, of the pads 47 on the upper face of the piezoelectric layer 43.

Each dummy electrode 48*c* has a plan-view shape of an approximate rectangle whose length in the scanning direction is shorter than that of the dummy electrode 48*b*. The dummy electrodes 48*c* are arranged between the inspection electrodes 46 and the pads 47 corresponding to the inspection space 17*a* and the inspection electrodes 46 and the pads 47 corresponding to the inspection space 17*b* on the upper face of the piezoelectric layer 43, and are aligned in the sheet feed direction. Further, the dummy electrodes 48*c* are aligned in two rows in the scanning direction. Then, the dummy electrodes 48*c* constituting one row are aligned with the inspection electrodes 46 and the dummy electrodes 48*a* in the sheet feed direction. Further, the dummy electrodes 48*c* constituting the other row are aligned with the pads 47 and the dummy electrodes 48*b* in the sheet feed direction.

The dummy electrodes 48*a* to 48*c* are not connected to other electrodes, wirings, and the like, and receive no voltage differently from the individual electrodes 45 and the inspection electrodes 46.

In the piezoelectric actuator 22 having the above-mentioned configuration, each part overlapping with each of the plurality of pressure chambers 10 constitutes a pressure applying section 22*a* applying a pressure to the ink in the corresponding pressure chamber 10. Similarly to the plurality of pressure chambers 10, the plurality of pressure applying sections 22*a* are aligned in a staggered array in the sheet feed direction so as to form four rows of the pressure applying sections 22*a* aligned in the scanning direction.

Further, in the piezoelectric actuator 22, the parts overlapping with the inspection spaces 17*a* to 17*c* constitute inspecting sections 22*b*1 to 22*b*3, respectively. Thus, the inspecting sections 22*b*1 and 22*b*2 are arranged respectively at positions deviating from both end parts and an approximately center part, in the sheet feed direction, of the row of the pressure applying sections 22*a* toward both sides in the scanning direction, and are aligned in the sheet feed direction. Further, the inspecting sections 22*b*3 are arranged on both sides, in the sheet feed direction, of the four rows of the pressure applying sections 22*a*, and are aligned in the scanning direction.

Since the inspecting sections 22*b*1 to 22*b*3 is arranged in this manner, the inspecting sections 22*b*1 to 22*b*3 are arranged symmetrically with respect to a straight line L extending in the scanning direction. That is, the inspecting sections 22*b*1 to 22*b*3 are arranged symmetrically with the sheet feed direction in the piezoelectric actuator 22. Further, the dummy electrodes 48*a* to 48*c* also are arranged symmetrically with respect to the straight line L.

A method that the piezoelectric actuator 22 is driven so that ink is ejected through the nozzles 15 in the ink jet head 3 is described below. In the piezoelectric actuator 22, all individual electrodes 45 are held at the ground potential in advance by the driver IC. When ink is to be ejected through a particular nozzle 15, the potential of the corresponding individual electrode 45 is switched to a driving potential. Then, a voltage is applied to the part located between the individual electrode 45 and the common electrode 44 in the piezoelectric layer 43 so that an electric field parallel to the polarization direction is generated in said part of the piezoelectric layer. The electric field causes said part of the piezoelectric layer 43 to contract in a horizontal direction which is perpendicular to the polarization direction. Thus, the part of the ink separation layer 41, the ceramics layer 42, and the piezoelectric layer 43 overlapping with the pressure chamber 10 is deformed in a manner that the entirety becomes convex on the pressure chamber 10 side, so that the capacity of the pressure chamber 10 decreases. As a result, the pressure of the ink in the pressure chamber 10 rises so that the ink is ejected through the nozzle 15 which is in communication with the pressure chamber 10.

Figure 5:
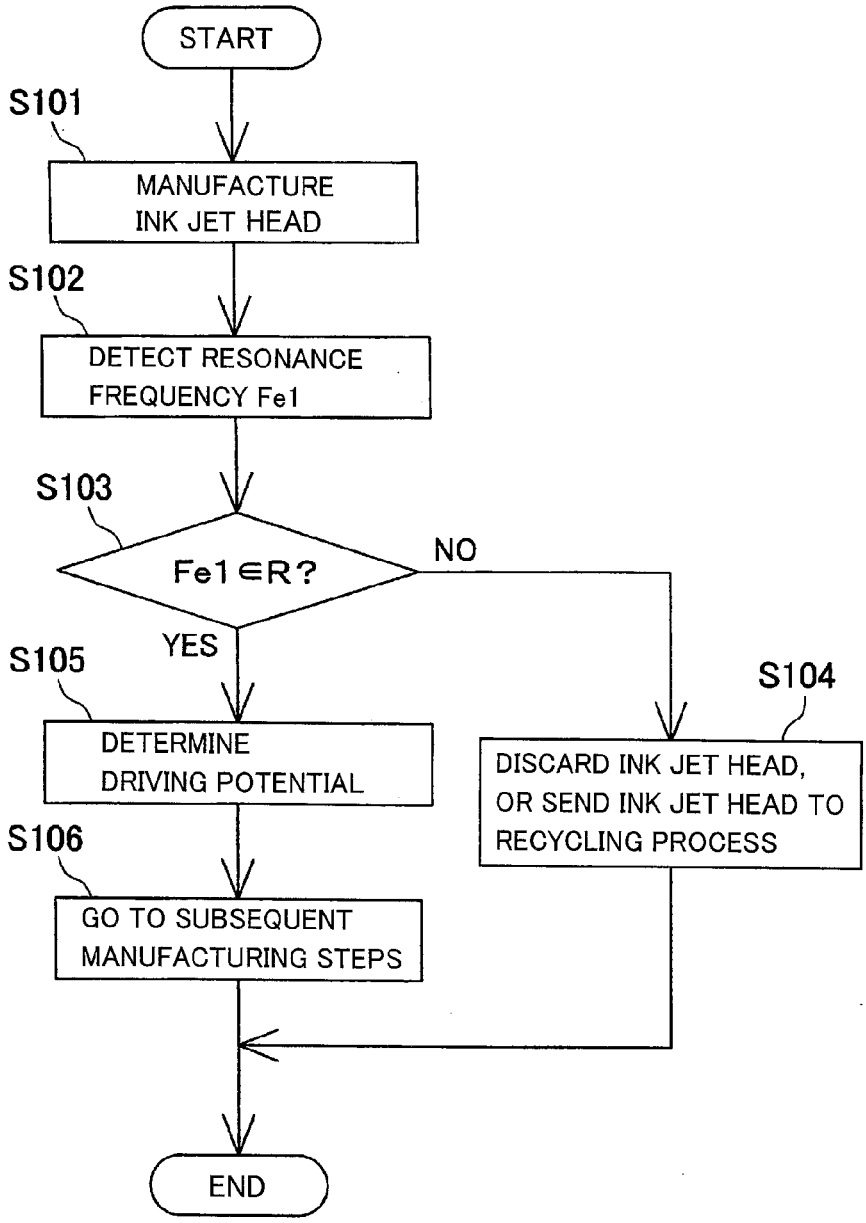
FIG. 5 is a process chart illustrating a manufacturing procedure for the printer.

Next, a manufacturing method for the printer 1 is described below with reference to the flow chart in FIG. 5. In the manufacturing of the printer 1, as illustrated in FIG. 5, the ink jet head 3 is manufactured first (step S101; simply referred to as S101 or the like in the following description).

At that time, when certain two members among a plurality of members in the ink jet head 3 are to be joined to each other, adhesive is applied to an approximately center part of the to-be-joined surface of one member. Then, the two members are pressed against each other so that the applied adhesive is spread over the entire to-be-joined surfaces. This avoids a situation that air remains between the joined surfaces after the joining of the two members.

Figure 6:
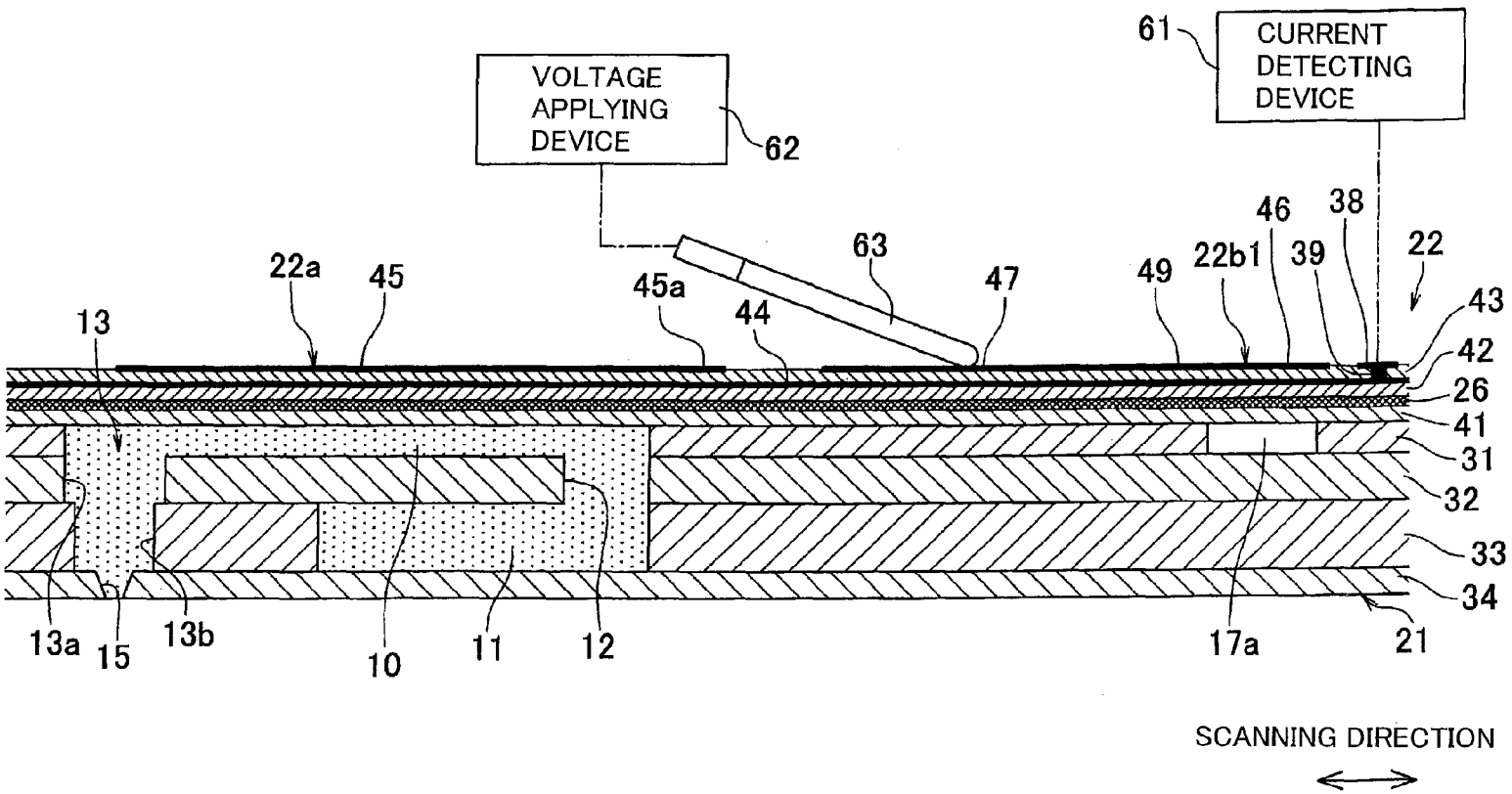
FIG. 6 is a diagram illustrating a situation that an inspecting section detects a resonance frequency.

Then, the resonance frequencies Fe1 of the plurality of inspecting sections 22*b*1 to 22*b*3 are detected (S102). Specifically, for example, as illustrated in FIG. 6, a current detecting device 61 is connected through the surface electrode 38 to the common electrode 44, and then a probe 63 connected to a voltage applying device 62 is contacted to the pad 47 corresponding to the inspection electrode 46. Then, a voltage is applied from the voltage applying device 62 through the probe 63, the pad 47, and the conduction section 49 to the inspection electrode 46. Then, with the frequency of the voltage being changed successively, a value Ie of a current outputted from the common electrode 44 is detected.

Figure 7:
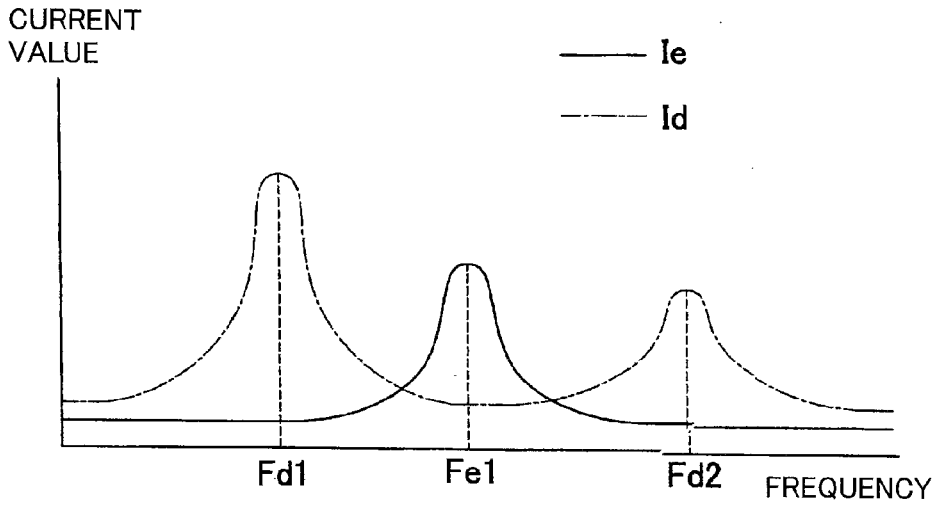
FIG. 7 is a diagram illustrating a relation between the frequency of a voltage applied to an electrode and the value of an output current.

At that time, as illustrated in FIG. 7, when the frequency of the voltage applied to the inspection electrode 46 becomes equal to each resonance frequency of the inspecting sections 22*b*1 to 22*b*3, the value Ie of the current outputted from the common electrode 44 becomes extremely high in comparison with a case that the frequency is not equal to each resonance frequency of the inspecting sections 22*b*1 to 22*b*3. On the basis of this fact, the frequency of the voltage applied to the inspection electrode 46 at the time when the peak of the current value Ie is obtained is concluded as each resonance frequency of the inspecting sections 22*b*1 to 22*b*3.

Also for each pressure applying section 22*a*, similarly to the above-mentioned method, as illustrated in FIG. 7, when the frequency of the voltage applied to the individual electrode 45 becomes equal to the resonance frequency of the pressure applying section 22*a*, a value Id of a current outputted from the common electrode 44 becomes extremely high in comparison with a case that the frequency is not equal to the resonance frequency of the pressure applying section 22*a*.

On the other hand, in the first embodiment, the inspection spaces 17*a* to 17*c* have plan-view shapes different from the pressure chambers 10. Thus, the resonance frequencies of the inspecting sections 22*b*1 to 22*b*3 are different from the resonance frequencies of the pressure applying sections 22*a*. More specifically, for example, as illustrated in FIG. 7, the resonance frequency Fe1 of the inspecting sections 22*b*1 to 22*b*3 in the primary oscillation mode is almost in the middle between the resonance frequency Fd1 of the pressure applying section 22*a* in the primary oscillation mode and the resonance frequency Fd2 in the secondary oscillation mode. In the first embodiment, the resonance frequency Fe1 in the primary oscillation mode is adopted as each resonance frequency of the inspecting sections 22*b*1 to 22*b*3.

Next, it is determined whether or not each resonance frequency Fe1 of the plurality of inspecting sections 22*b*1 to 22*b*3 falls within a predetermined range R (S 103). When the resonance frequency Fe1 of any inspecting sections 22*b*1 to 22*b*3 falls outside the predetermined range R (S103: NO), it is concluded that the piezoelectric actuator 22 is defective. Thus, the ink jet head 3 provided with this piezoelectric actuator 22 is discarded, or alternatively the ink jet head 3 is sent to a decomposing and recycling process (S104). Then, the process flow is ended.

On the other hand, when the resonance frequencies Fe1 of all inspecting sections 22*b*1 to 22*b*3 falls within the predetermined range R (S103: YES), driving potentials to be applied to the plurality of individual electrodes 45 are determined individually in correspondence to the resonance frequencies Fe1 (S105).

Then, the procedure goes to subsequent manufacturing steps in the manufacturing of the printer 1 like the step of attaching the driver IC to the ink jet head 3 and the step of attaching the ink jet head 3 to the carriage 2 (S106). Then, manufacturing of the printer 1 is completed and the process flow is ended.

According to the first embodiment described above, the resonance frequencies Fe1 of the inspecting sections 22*b*1 to 22*b*3 are in correlation with the thicknesses of the inspecting sections 22*b*1 to 22*b*3. Further, the inspecting sections 22*b*1 and 22*b*2 are arranged at positions deviating from the row of the pressure applying sections 22*a* toward both sides in the scanning direction, and are aligned in the sheet feed direction. Thus, when the resonance frequencies Fe1 of the inspecting sections 22*b*1 to 22*b*3 are detected and then in correspondence to the detected resonance frequencies Fe1, driving potentials to be applied to the plurality of individual electrodes 45 are determined, variation can be controlled in the ejection characteristics of the ink ejected from the plurality of nozzles 15.

Further, in order to avoid a situation that air remains between joined surfaces in the manufacturing of the ink jet head 3, as described above, adhesive is applied to the center part of the to-be-joined surface of one member and then the two to-be-joined members are pressed against each other so that the applied adhesive is spread over the entire to-be-joined surfaces and the two members are joined to each other. In this case, adhesive reaches the edge parts of the to-be-joined surfaces at a final stage. Thus, the adhesive reaches there with certain difficulty. This easily causes variation in the thickness of the adhesive in the edge parts and hence easily causes larger variation in the ink ejection characteristics of the nozzles 15 corresponding to the pressure applying sections 22*a* located on both end sides in the sheet feed direction than in the nozzles 15 corresponding to the pressure applying sections 22*a* located in the center part.

In contrast, in the first embodiment, the inspecting sections 22*b*1 aligned in the sheet feed direction are provided respectively at positions deviating from both end parts, in the sheet feed direction, of the row of the pressure applying sections 22*a* toward both sides in the scanning direction. Then, in correspondence to the resonance frequencies of the inspecting sections 22*b*1, driving potentials for the pressure applying sections 22*a* on both end sides with respect to the sheet feed direction are determined and used, and thereby reliably controlling variation in the ejection characteristics of the ink ejected from the plurality of nozzles 15 corresponding to these pressure applying sections 22*a*.

Further, in the first embodiment, the inspecting sections 22*b*2 are further provided at positions deviating from an approximately center part, in the sheet feed direction, of the row of the pressure applying sections 22*a* toward both sides in the scanning direction. As described above, in the piezoelectric actuator 22, a large difference occurs in the thickness of the adhesive 26 on both end sides and in the center part with respect to the sheet feed direction. In contrast, in the first embodiment, in addition to the inspecting sections 22*b*1, the inspecting sections 22b2 are provided at positions deviating from the center part, in the sheet feed direction, of the row of the pressure applying sections 22a toward both sides in the scanning direction. Then, in correspondence to the resonance frequencies of the inspecting sections 22b1 and 22b2, driving potentials for the pressure applying sections 22a are determined and used, and thereby controlling variation in the ink ejection characteristics of the nozzles 15 located on both end sides and of the nozzles 15 located in the center part with respect to the sheet feed direction.

Further, in the first embodiment, the inspecting sections 22b1 and 22b2 are provided for each row of the pressure applying sections 22a. Further, the inspecting sections 22b3 aligned in the scanning direction are arranged on both sides, in the sheet feed direction, of the four rows of the pressure applying sections 22a. Then, in correspondence to the resonance frequencies of the inspecting sections 22b1 to 22b3, a driving potential for each pressure applying section 22a is determined and used, and thereby controlling variation in the ink ejection characteristics among the nozzles 15 corresponding to mutually different pressure applying sections 22a.

Further, in the first embodiment, each of the inspecting sections 22b1 to 22b3 has a plan-view shape of an approximate circle. Thus, when the frequency of the voltage applied to the inspection electrode 46 is changed, a sharp peak arises in a value Ie of the current outputted from the common electrode 44. This permits easy detection of the resonance frequency.

Further, in the first embodiment, each pad 47 has an area larger than that of each individual electrode 45. This permits easy contact of the probe 63 to the pad 47.

Further, in the piezoelectric actuator 22, a difference is present between the linear expansion coefficient of the piezoelectric layer 43 and the linear expansion coefficients of the individual electrodes 45, the inspection electrodes 46, and the pads 47 formed on the upper face of the piezoelectric layer 43. Thus, if the dummy electrodes 48a to 48c were not arranged on the upper face of the piezoelectric layer 43, as a result of heating at the time of joining the piezoelectric layer 43 and the ceramics layer 42 with adhesive, the piezoelectric layer 43 and the ink separation layer 41 plus the ceramics layer 42 joined to the piezoelectric layer 43 could warp owing to the above-mentioned difference in the linear expansion coefficients.

In contrast, in the first embodiment, the dummy electrodes 48a are arranged on both sides, in the sheet feed direction, of the inspection electrodes 46 on the upper face of the piezoelectric layer 43. Further, the dummy electrodes 48b are arranged on both sides, in the sheet feed direction, of the pads 47 on the upper face of the piezoelectric layer 43. Further, the plurality of dummy electrodes 48c aligned in two rows in the sheet feed direction are arranged between the inspection electrodes 46 and the pads 47 corresponding to the inspecting sections 22b1 and the inspection electrodes 46 and the pads 47 corresponding to the inspecting sections 22b2 on the upper face of the piezoelectric layer 43. That is, on the upper face of the piezoelectric layer 43, the individual electrodes 45, the inspection electrodes 46, the pads 47, and the dummy electrodes 48a to 48c are arranged uniformly over the entire region, and thereby controlling warpage in the ink separation layer 41, the ceramics layer 42, and the piezoelectric layer 43 that is caused by the above-mentioned difference in the linear expansion coefficients.

Further, in the first embodiment, the inspection electrodes 46 and the dummy electrodes 48a and 48c are aligned approximately at equal intervals in the sheet feed direction similarly to the pads 47 and the dummy electrodes 48b and 48c. Thus, on the upper face of the piezoelectric layer 43, the individual electrodes 45, the inspection electrodes 46, the pads 47, and the dummy electrodes 48a to 48c are arranged remarkably uniformly over the entire region, and thereby reliably controlling the above-mentioned warpage in the ink separation layer 41, the ceramics layer 42, and the piezoelectric layer 43.

In addition, in the first embodiment, the inspection electrodes 46, the pads 47, and the dummy electrodes 48a to 48c are arranged symmetrically with respect to the straight line L. Thus, a stress acting on the piezoelectric layer 43 caused by the above-mentioned difference in the linear expansion coefficients occurs symmetrically with respect to the straight line L. Thus, stress variation does not occur between the parts on both sides with respect to the straight line L, and thereby reliably controlling the above-mentioned warpage in the ink separation layer 41, the ceramics layer 42, and the piezoelectric layer 43. Here, in the above-mentioned description, the ceramics layer 42 and the piezoelectric layer 43 are joined to each other with adhesive. However, employable configurations are not limited to this. That is, a stack obtained by stacking with each other a green sheet on which electrode material constituting the common electrode 44 is applied and a green sheet on which electrode material constituting the plurality of individual electrodes 45, the plurality of inspection electrodes 46, the plurality of pads 47, the plurality of dummy electrodes 48a to 48c, and the like is applied may be sintered and used for the piezoelectric actuator 22. Also in this case, employment of the dummy electrodes 48a to 48c controls warpage in the stack caused by the sintering.

Further, in the first embodiment, as described above, the plurality of inspecting sections 22b1 to 22b3 are arranged non-uniformly in the piezoelectric actuator 22, for example, the inspecting sections 22b1 and 22b2 are arranged only in the regions corresponding to both end parts and an approximately center part in the sheet feed direction among the regions deviating from the row of the pressure applying sections 22a toward both sides in the scanning direction. That is, the inspection electrodes 46 and the pads 47 are arranged non-uniformly in the regions on the upper face of the piezoelectric layer 43. However, the dummy electrodes 48a to 48c are arranged in the regions of the piezoelectric layer 43 where the inspection electrodes 46 and the pads 47 are not formed. Thus, the individual electrodes 45, the inspection electrodes 46, the pads 47, and the dummy electrodes 48a to 48c are arranged uniformly over the entire region on the upper face of the piezoelectric layer 43.

Differently from the first embodiment, a plurality of inspecting sections aligned in the sheet feed direction might be provided over the entire regions on both sides of the row of the pressure applying sections 22a. In this case, the individual electrodes 45, the inspection electrodes 46, and the pads 47 are arranged uniformly over the entire region on the upper face of the piezoelectric layer 43. Nevertheless, in this case, a large number of the pads 47 each having an area larger than that of each of the individual electrodes 45 are arranged on the upper face of the piezoelectric layer 43. Thus, the above-mentioned warpage occurs easily in the ink separation layer 41, the ceramics layer 42, and the piezoelectric layer 43. Further, in this case, even when dummy electrodes are further provided in the regions between the pads 47 or the like on the upper face of the piezoelectric layer 43, a possibility arises that the above-mentioned warpage is not satisfactorily controlled in the ink separation layer 41, the ceramics layer 42, and the piezoelectric layer 43.

In contrast, in the first embodiment, as described above, the inspection electrodes 46 and the pads 47 are arranged non-uniformly in the regions on the upper face of the piezoelectric layer 43. Further, the dummy electrodes 48*b* and 48*c* each having an area smaller than that of each of the pads 47 are arranged between the pads 47 on the upper face of the piezoelectric layer 43, and thereby reliably controlling the above-mentioned warpage in the ink separation layer 41, the ceramics layer 42, and the piezoelectric layer 43.

Here, in the first embodiment, the ink separation layer 41 corresponds to the first layer described in the claims. Further, an element obtained by combining the ceramics layer 42 with the piezoelectric layer 43 corresponds to the second layer described in the claims. The individual electrode 45 corresponds to the driving electrode described in the claims. Further, the sheet feed direction corresponds to the one direction described in the claims and the scanning direction corresponds to the perpendicular direction described in the claims.

[Second Embodiment]

Next, a preferable second embodiment is described below. Here, the second embodiment is different from the first embodiment merely in part. Thus, the following description is given with focusing attention mainly on the parts different from the first embodiment. Then, description of like components to the first embodiment is omitted appropriately.

Figure 8:
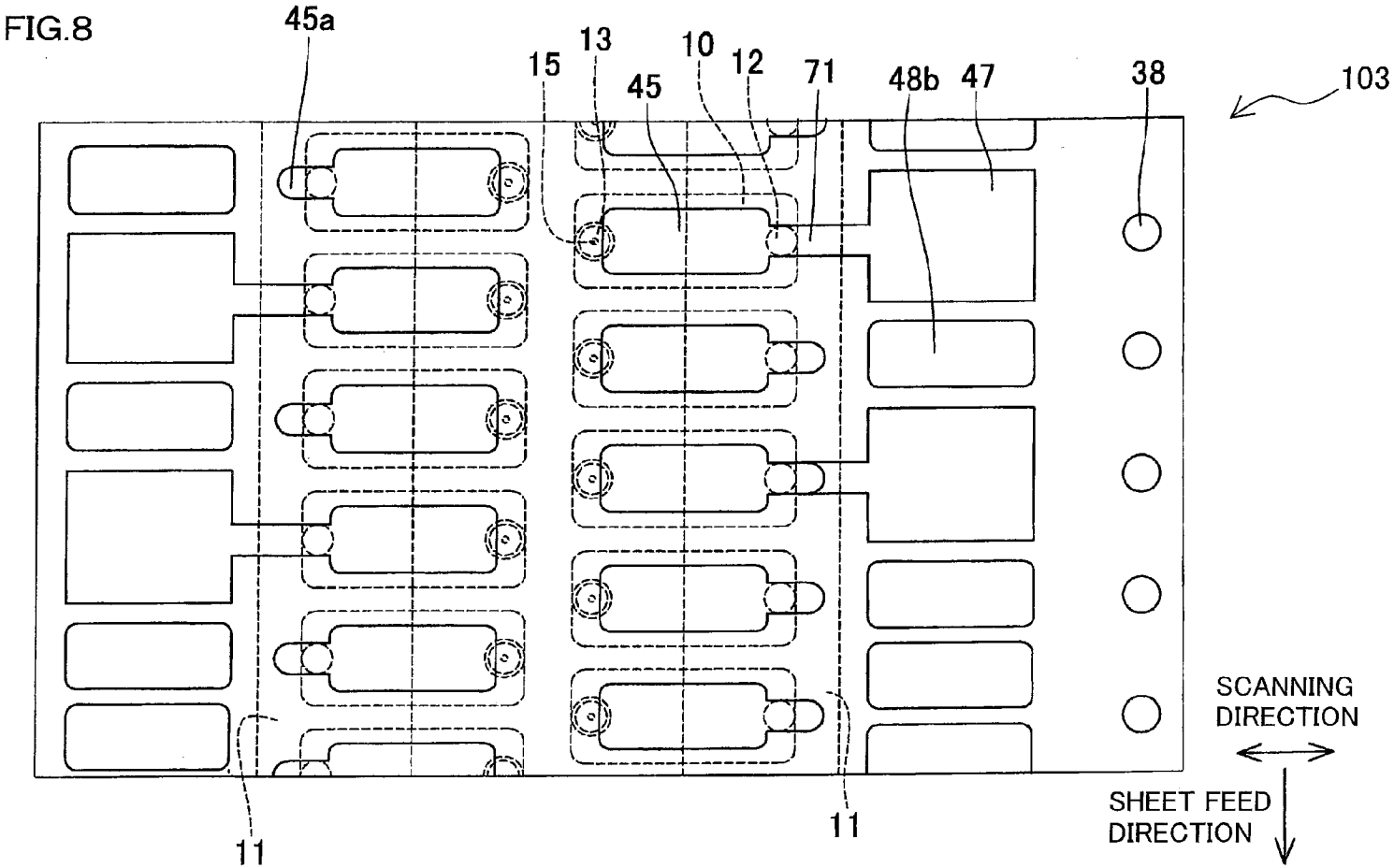
FIG. 8 is a diagram corresponding to FIG. 3 and illustrating a second embodiment.

As illustrated in FIG. 8, an ink jet head 103 according to the second embodiment is not provided with: the inspection spaces 17*a* to 17*c*; the inspecting sections 22*b*1 to 22*b*3; the dummy electrodes 48*a*; and the dummy electrodes 48*c* aligned with the dummy electrodes 48*a* in the sheet feed direction. Further, each individual electrode 45 and each pad 47 are connected to each other through a conduction section 71.

In the second embodiment, at S102 in the above-mentioned first embodiment, a voltage is applied to each individual electrode 45 through the pad 47 and the conduction section 71 and then the frequency of the voltage is changed so that the resonance frequency Fd1 of the pressure applying section 22*a* in the primary resonance mode is detected (see FIG. 7). After that, at S105, driving potentials to be applied to the plurality of individual electrodes 45 are determined individually in correspondence to the resonance frequencies Fd1 of the pressure applying sections 22*a* detected at S102.

The resonance frequencies Fd1 of the plurality of pressure applying sections 22*a* correspond to the thicknesses of the pressure applying sections 22*a*. Further, in each row of the pressure applying sections 22*a*, the pressure applying section 22*a* whose resonance frequency is detected and the other pressure applying sections 22*a* are aligned in the sheet feed direction. Thus, in the second embodiment, in correspondence to the resonance frequencies Fd1 of the plurality of pressure applying sections 22*a*, driving potentials to be applied to the individual electrodes 45 are determined and used, and thereby controlling variation in the ejection characteristics of the ink ejected from the plurality of nozzles 15.

Further, in the second embodiment, a part of the plurality of pressure applying sections 22*a* serve also as inspecting sections used for detecting the resonance frequencies. This avoids the necessity of inspecting sections provided separately from the pressure applying sections 22*a* and hence permits size reduction in the ink jet head 103.

Further, also in the second embodiment, the dummy electrodes 48*b* and 48*c* aligned with the pads 47 in the sheet feed direction are formed on the upper face of the piezoelectric layer 43. Thus, similarly to the first embodiment, warpage in the ink separation layer 41, the ceramics layer 42, and the piezoelectric layer 43 can be controlled that is caused by the above-mentioned difference in the linear expansion coefficients.

Next, modifications are described below that are obtained by making various kinds of changes in the first and the second embodiments. Here, description of like components to the first and the second embodiments are omitted appropriately.

Figure 9:
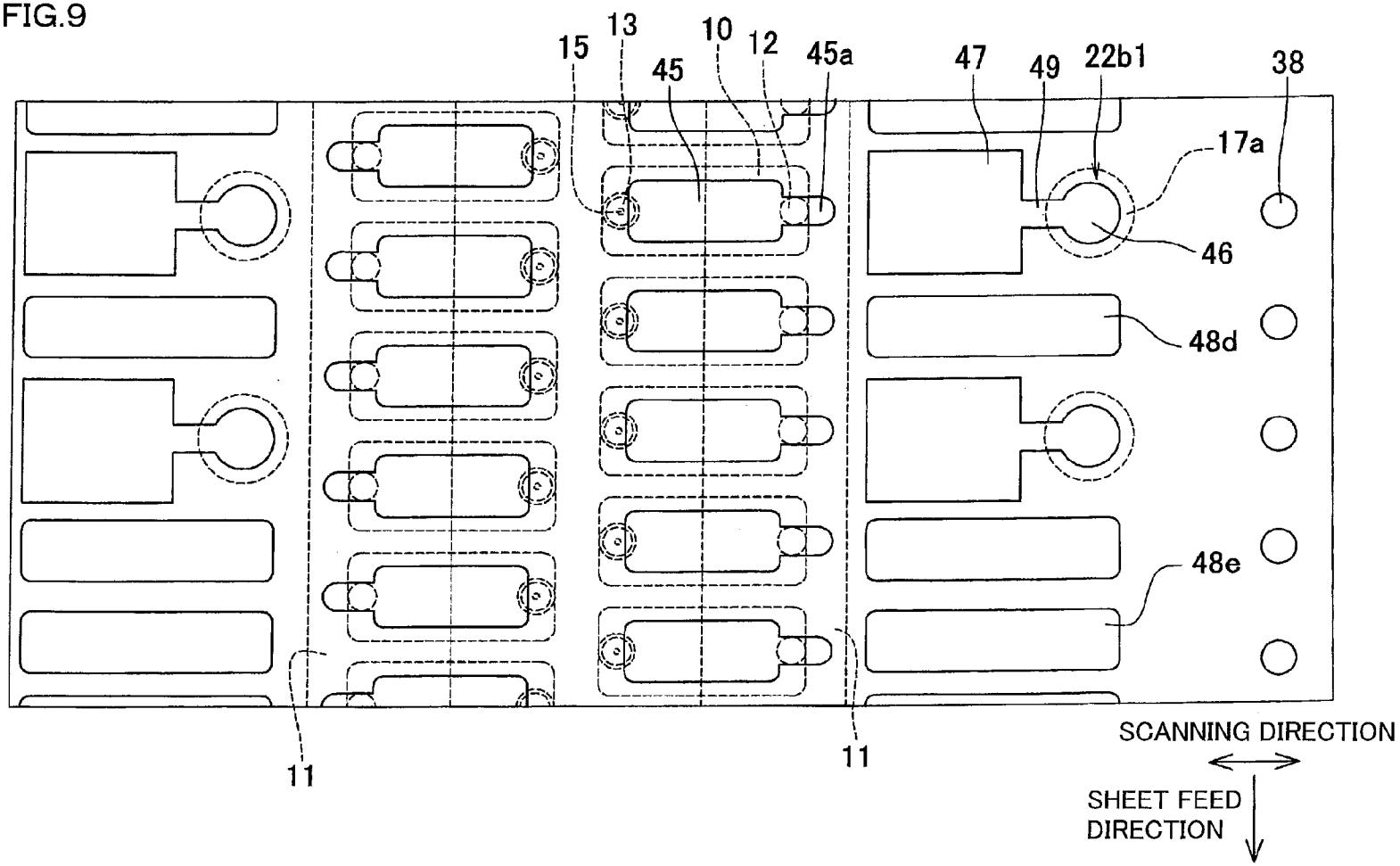
FIG. 9 is a diagram corresponding to FIG. 3 and illustrating modification 1.

In the first embodiment, three kinds of the dummy electrodes 48*a* to 48*c* are formed on the upper face of the piezoelectric layer 43. However, employable configurations are not limited to this. In a modification (modification 1), as illustrated in FIG. 9, in place of the dummy electrodes 48*a* and 48*b* a dummy electrode 48*d* extending in the scanning direction is formed in the region where the dummy electrodes 48*a* and 48*b* are arranged. Further, in place of the dummy electrodes 48*c* arranged in two rows in the scanning direction, a dummy electrode 48*e* extending in the scanning direction is formed in the region where two rows of the dummy electrodes 48*c* are arranged. The dummy electrodes 48*d* and 48*e* are aligned with both of the inspection electrodes 46 and the pads 47 in the sheet feed direction. In this case, similarly to the first embodiment, warpage in the ink separation layer 41, the ceramics layer 42, and the piezoelectric layer 43 can be controlled that is caused by the above-mentioned difference in the linear expansion coefficients.

Further, in the first embodiment, the inspection electrodes 46 and the dummy electrodes 48*a* and 48*c* are arranged approximately at equal intervals in the sheet feed direction. Further, in the first and the second embodiments, the pads 47 and the dummy electrodes 48*b* and 48*c* are arranged approximately at equal intervals in the sheet feed direction. However, employable configurations are not limited to this. That is, the arrangement intervals of the inspection electrodes 46 and the dummy electrodes 48*a* and 48*c* and the arrangement intervals of the pads 47 and the dummy electrodes 48*b* and 48*c* may be non-uniform.

Further, in the first embodiment, the dummy electrodes are aligned with both of the inspection electrodes 46 and the pads 47 in the sheet feed direction. However, employable configurations are not limited to this. For example, among the dummy electrodes 48*a* to 48*c*, only the dummy electrodes 48*a* and 48*c* may be provided that are aligned with the inspection electrodes 46 in the sheet feed direction. Alternatively, among the dummy electrodes 48*a* to 48*c*, only the dummy electrodes 48*b* and 48*c* may be provided that are aligned with the pads 47 in the sheet feed direction.

Further, in the first and the second embodiments, each of the dummy electrodes 48*b* and 48*c* aligned with the pads 47 in the sheet feed direction has an area smaller than that of each of the pads 47. However, employable configurations are not limited to this. That is, each of the areas of the dummy electrodes 48*b* and 48*c* may be similar to that of each of the pads 47 or alternatively may be greater than that of each of the pads 47.

Even in these cases, in comparison with a case that the dummy electrodes 48*a* to 48*c* are formed on the upper face of the piezoelectric layer 43, warpage in the ink separation layer 41, the ceramics layer 42, and the piezoelectric layer 43 can be controlled that is caused by the above-mentioned difference in the linear expansion coefficients.

Further, in the above-mentioned examples, the dummy electrodes are formed on the upper face of the piezoelectric layer 43. Instead, the dummy electrodes may be not formed.

Figure 10:
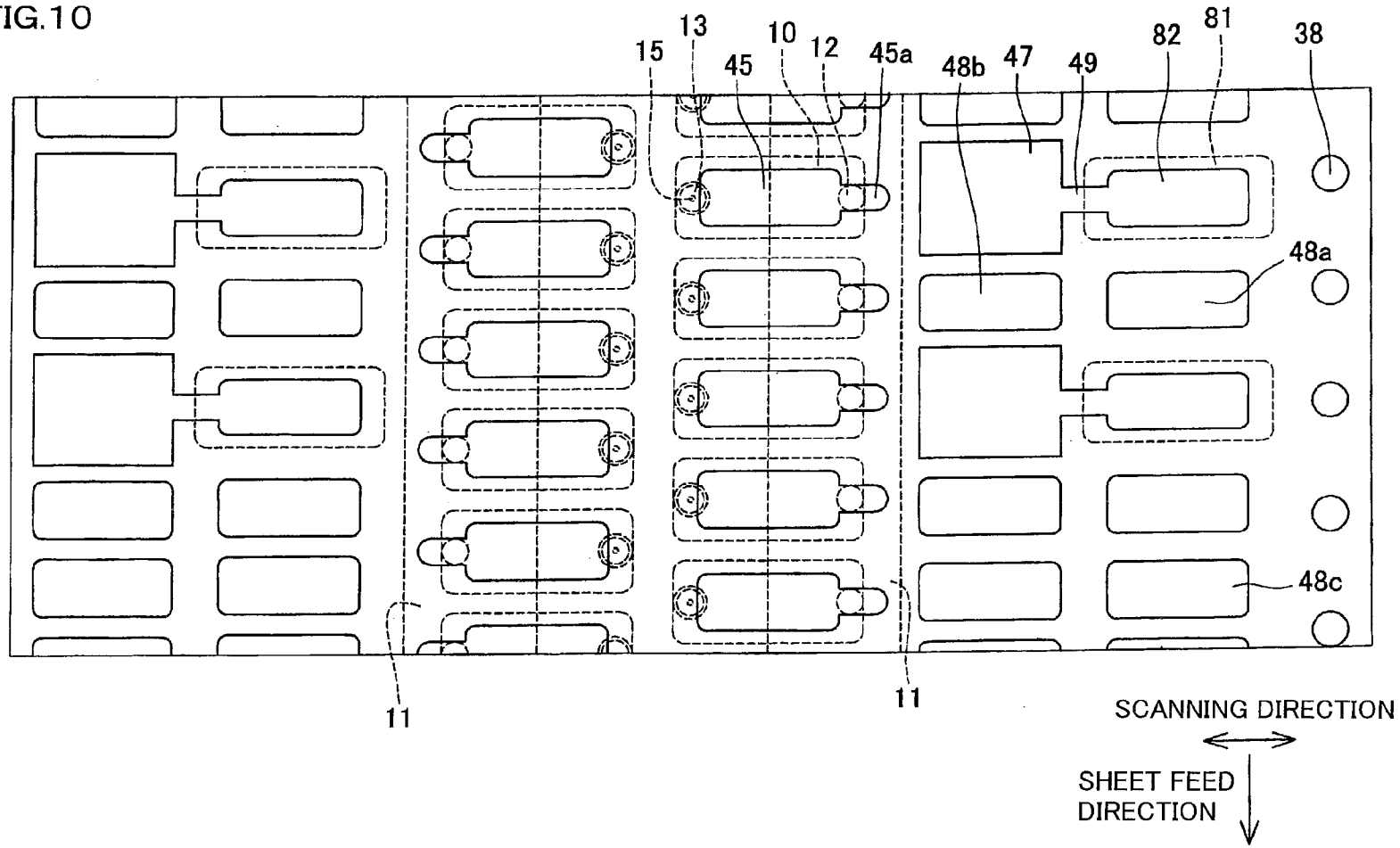
FIG. 10 is a diagram corresponding to FIG. 3 and illustrating modification 2.

Further, in the first embodiment, each of the inspecting sections 22*b*1 to 22*b*3 has a plan-view shape of an approximate circle. However, employable configurations are not limited to this. In another modification (modification 2), as illustrated in FIG. 10, each inspection space 81 formed in the plate 31 of the passage unit 21 has a plan-view shape of an approximate rectangle which is almost the same as the shape of each pressure chamber 10. Here, each inspection space 81 in FIG. 10 corresponds to the inspection space 17*a*. Then, inspection spaces corresponding to the inspection spaces 17*b* and 17*c* also have similar shapes. Further, in correspondence to this, each inspection electrode 82 has a plan-view shape of an approximate rectangle which is almost the same as the shape of each individual electrode 45. That is, the plan-view shape of the inspecting section is almost the same as that of each pressure applying section 22*a*. Here, in modification 2, in correspondence to the shapes of the inspection electrodes 82, the shapes of the dummy electrodes 48*a* and 48*c* are different from those in the first embodiment.

In this case, the resonance frequency of each pressure applying section 22*a* is almost the same as each resonance frequency of the inspecting sections 22*b*1 to 22*b*3. Thus, when the resonance frequencies of the inspecting sections 22*b*1 to 22*b*3 are detected and then driving potentials are determined in correspondence to the detected resonance frequencies, variation can be reliably controlled in the liquid ejection characteristics of the nozzles 15.

Further, the plan-view shapes of the inspecting sections 22*b*1 to 22*b*3 are not limited to circular shapes or alternatively the same shapes as those of the pressure applying sections 22*a*. For example, square shapes or the like may be employed that are different from circular shapes or the plan-view shapes of the pressure applying sections 22*a*.

Further, in the first embodiment, the inspecting sections 22*b*1 to 22*b*3 are provided in the piezoelectric actuator 22. However, employable arrangements of the inspecting sections are not restricted to this.

For example, the inspecting sections 22*b*3 may be not provided. In this case, the regions where the inspecting sections 22*b*3 are to be arranged need not be provided in both end parts, in the sheet feed direction, of the piezoelectric actuator 22. This permits size reduction in the piezoelectric actuator 22.

Here, in a case that the inspecting sections 22*b*3 are omitted, a possibility arises that variation occurs in the ink ejection characteristics among the nozzles 15 corresponding to mutually different pressure chamber rows 9. However, in correspondence to the resonance frequencies of the inspecting sections 22*b*1 and 22*b*2, driving potentials to be applied to the individual electrodes 45 are determined and used, and thereby controlling variation in the ink ejection characteristics among the plurality of nozzles 15 corresponding to one pressure chamber row 9.

For example, in the printer 1, ink is ejected from the ink jet head 3 that travels together with the carriage 2 in the scanning direction onto a recording sheet P. Then, the sheet conveying roller 4 conveys the recording sheet P by a distance equal to the length of the row of the nozzles 15 aligned in the sheet feed direction. Such operation (referred to as a unit recording action, hereinafter) is repeated so that printing is performed.

In this case, in a printed image, in a boundary part between two parts generated by two successive unit recording actions, dots formed with ink ejected through the nozzles 15 located in one end part in the sheet feed direction and dots formed with ink ejected through the nozzles 15 located in the other end part align with each other in a manner of being adjacent to each other in the sheet feed direction.

The pressure applying sections 22*a* corresponding to these nozzles 15 are largely separated from each other. Thus, a large difference is expected in the thicknesses of these pressure applying sections 22*a*. Accordingly, if an identical driving potential were applied to the individual electrodes 45 of these pressure applying sections 22*a*, non-uniformity arises in the above-mentioned boundary part in the printed image and hence image quality is degraded largely. Thus, in order that such degradation in image quality should be controlled in the printed image, variation in the ink ejection characteristics need be satisfactorily controlled among the plurality of nozzles 15 corresponding to one pressure chamber row 9.

In contrast, in the image, dots formed with ink ejected through the nozzles 15 located at the same position in the sheet feed direction align with each other in the scanning direction. On the other hand, the pressure applying sections 22*a* corresponding to the nozzles 15 located at the same position in the sheet feed direction are located at mutually close positions. Thus, not so large variation in the thickness is present among these pressure applying sections 22*a*. That is, even when the same driving potential is applied to the individual electrodes 45, not so large variation in the ink ejection characteristics occurs in the nozzles 15 located at the same position in the sheet feed direction among the nozzles 15 corresponding to mutually different rows of the pressure applying sections 22*a*.

Thus, even in a case that the inspecting sections 22*b*3 are omitted and that in correspondence to the resonance frequencies of the inspecting sections 22*b*1 and 22*b*2, driving potentials to be applied to the plurality of individual electrodes 45 are determined and used, the image quality in the printed image is not so largely degraded.

Further, the inspecting sections 22*b*1 and 22*b*2 may be provided only for a part of the rows of the pressure applying sections 22*a*. The distribution of the thickness of the piezoelectric actuator 22 in the sheet feed direction has a similar tendency regardless of the position in the scanning direction. Thus, in correspondence to the resonance frequencies of the inspecting sections 22*b*1 and 22*b*2 provided only in a part of the rows of the pressure applying sections 22*a*, driving potentials for all pressure applying sections 22*a* are determined and used, and thereby controlling variation in the ink characteristics among the plurality of nozzles 15 corresponding to each pressure chamber row 9.

Further, employable positions for the inspecting sections provided in correspondence to the rows of the pressure applying sections 22*a* are not limited to those described above. For example, the inspecting sections 22*b*2 may be not provided. When members constituting the ink jet head 3 are joined to each other with adhesive, as described above, variation in the thickness of the piezoelectric actuator 22 easily occurs in the edge part and hardly occurs in the center part. Thus, driving potentials for the pressure applying sections 22*a* on both end parts in the sheet feed direction may be determined and used in correspondence to the resonance frequencies of the inspecting sections 22*b*1. Further, driving potentials for the pressure applying sections 22*a* in the center part may be a driving potential determined at the design phase. Even this approach can control variation in the ejection characteristics of the ink ejected from the plurality of nozzles 15 to a certain extent.

Further, as long as a plurality of inspecting sections are provided and aligned with the pressure applying sections 22*a* in the sheet feed direction, the inspecting sections may be arranged in regions different from the those described above among the regions deviating from each row of the pressure applying sections 22*a* toward both sides in the scanning direction. Further, a plurality of inspecting sections aligned in the sheet feed direction may be arranged over the entire region deviating from each row of the pressure applying sections 22*a* toward both sides in the scanning direction. Further, the inspecting sections provided in correspondence to the pressure applying sections 22*a* may be provided only in the region deviating from the row of the pressure applying sections 22*a* toward one side in the scanning direction.

Further, in the above-mentioned examples, the ceramics layer 42 and the piezoelectric layer 43 extends such as to overlap with all pressure chambers 10 and all inspection spaces 17*a* to 17*c*. However, employable configurations are not limited to this. For example, on the upper face of the ink separation layer 41, the ceramics layer 42 and the piezoelectric layer 43 may be provided individually for each pressure chamber row 9.

Further, in the above-mentioned examples, driving potentials are determined and used in correspondence to the resonance frequencies of the inspecting sections so that variation in the ejection characteristics of the ink ejected from the nozzles 15 is controlled. However, employable configurations are not limited to this. For example, in place of determining the driving potentials, the waveforms of the driving signals may be determined.

Further, the above-mentioned description has been given for the examples of an ink jet head ejecting ink through a plurality of nozzles. However, employable applications are not limited to these. That is, an application may be a liquid ejection device ejecting liquid other than ink through a plurality of nozzles.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

What is claimed is:

1. A liquid ejection device comprising:

a passage unit in which a plurality of nozzles and a plurality of pressure chambers in communication with the plurality of nozzles are aligned in one direction respectively; and a piezoelectric actuator arranged on the passage unit and applying a pressure to liquid in the plurality of pressure chambers, wherein in the passage unit, a plurality of inspection spaces not in communication with the plurality of nozzles are provided away from the plurality of pressure chambers in a perpendicular direction which is perpendicular to the one direction, the piezoelectric actuator includes:

a first layer covering the plurality of pressure chambers and the plurality of inspection spaces;

a second layer including at least a piezoelectric layer and being provided on a side of the first layer opposite to a side covering the plurality of pressure chambers and the plurality of inspection spaces, in a manner of overlapping with the plurality of pressure chambers and the plurality of inspection spaces;

a plurality of driving electrodes provided at parts overlapping with the plurality of pressure chambers in the second layer;

a plurality of inspection electrodes provided at parts overlapping with the plurality of inspection spaces in the second layer; and a plurality of voltage applying pads connected respectively to the plurality of inspection electrodes, and the plurality of inspection electrodes are provided away from the plurality of driving electrodes in the perpendicular direction, and are aligned in the one direction.

2. The liquid ejection device according to claim 1, wherein the first layer and the second layer are joined to each other with adhesive, and the plurality of inspection electrodes are arranged symmetrically in the one direction.

3. The liquid ejection device according to claim 1, wherein the first layer and the second layer are joined to each other with adhesive, and the plurality of inspection electrodes are provided in correspondence to both end parts, in the one direction, of a row of the driving electrodes aligned in the one direction.

4. The liquid ejection device according to claim 3, wherein the plurality of inspection electrodes are further provided in correspondence to a center part, in the one direction, of the row of the driving electrodes.

5. The liquid ejection device according to claim 1, wherein each of the pads has an area greater than an area of each of the driving electrodes.

6. The liquid ejection device according to claim 1, wherein the second layer is provided with a dummy electrode to which a voltage is not applied, and the dummy electrode is aligned with at least either the plurality of inspection electrodes or the plurality of pads in the one direction.

7. The liquid ejection device according to claim 6, wherein the plurality of inspection electrodes are provided in correspondence to the driving electrodes located at a part of a row of the driving electrodes aligned in the one direction, a plurality of the dummy electrodes are provided that each has an area smaller than an area of each of the plurality of pads, and the plurality of dummy electrodes are aligned with the plurality of pads in the one direction.

8. The liquid ejection device according to claim 6, wherein a plurality of the dummy electrodes are provided, and the plurality of dummy electrodes are aligned at equal intervals in the one direction.

9. The liquid ejection device according to claim 1, wherein a plurality of rows each composed of the driving electrodes aligned in the one direction are provided in the perpendicular direction, and the plurality of inspection electrodes are further provided on both sides, in the one direction, of the plurality of rows of driving electrodes, and are aligned in the perpendicular direction.

10. The liquid ejection device according to claim 1, wherein each of the inspection spaces has a circular shape when viewed from an arrangement direction in which the piezoelectric actuator is arranged on the passage unit.

11. The liquid ejection device according to claim 1, wherein the inspection electrodes have the same shapes as the driving electrodes.

12. A liquid ejection device comprising;

a passage unit in which a plurality of nozzles and a plurality of pressure chambers in communication with the plurality of nozzles are aligned in one direction respectively; and a piezoelectric actuator arranged on the passage unit and applying a pressure to liquid in the plurality of pressure chambers, wherein the piezoelectric actuator includes:

a first layer covering the plurality of pressure chambers;

a second layer including at least a piezoelectric layer and being provided on a side of the first layer opposite to a side covering the plurality of pressure chambers, in a manner of overlapping with the plurality of pressure chambers;

a plurality of driving electrodes provided at parts overlapping with the plurality of pressure chambers in the second layer; and a plurality of voltage applying pads connected respectively to at least two or more driving electrodes among the plurality of driving electrodes, the driving electrodes connected respectively to the pads are inspection electrodes, and the inspection electrodes are aligned in the one direction.

13. The liquid ejection device according to claim 12, wherein the first layer and the second layer are joined to each other with adhesive, and the plurality of inspection electrodes are arranged symmetrically in the one direction.

14. The liquid ejection device according to claim 12, wherein the first layer and the second layer are joined to each other with adhesive, and the plurality of inspection electrodes are provided in correspondence to both end parts, in the one direction, of a row of the driving electrodes aligned in the one direction.

15. The liquid ejection device according to claim 14, wherein the plurality of inspection electrodes are further provided in correspondence to a center part, in the one direction, of the row of the driving electrodes.

16. The liquid ejection device according to claim 12, wherein each of the pads has an area greater than an area of each of the driving electrodes.

17. The liquid ejection device according to claim 12, wherein the second layer is provided with a dummy electrode to which a voltage is not applied, and the dummy electrode is aligned with at least either the plurality of inspection electrodes or the plurality of pads in the one direction.

18. The liquid ejection device according to claim 17, wherein the plurality of inspection electrodes are provided in correspondence to the driving electrodes located at a part of a row of the driving electrodes aligned in the one direction, a plurality of the dummy electrodes are provided that each has an area smaller than an area of each of the plurality of pads, and the plurality of dummy electrodes are aligned with the plurality of pads in the one direction.

19. The liquid ejection device according to claim 17, wherein a plurality of the dummy electrodes are provided, and the plurality of dummy electrodes are aligned at equal intervals in the one direction.

20. The liquid ejection device according to claim 12, wherein a plurality of rows each composed of the driving electrodes aligned in the one direction are provided in the perpendicular direction, and the plurality of inspection electrodes are further provided on both sides, in the one direction, of the plurality of rows of driving electrodes, and are aligned in the perpendicular direction.

21. The liquid ejection device according to claim 12, wherein the inspection electrodes have the same shapes as the driving electrodes.

* * * * *